United States Patent [19]

Ohsumi et al.

[11] Patent Number: 4,890,656

[45] Date of Patent: Jan. 2, 1990

[54] METHOD FOR PRODUCING WOODEN DECORATIVE ARTICLES

[75] Inventors: Hisayoshi Ohsumi; Taichi Ikeya, both of Shizuoka, Japan

[73] Assignee: Yamaha Corporation, Japan

[21] Appl. No.: 112,820

[22] Filed: Oct. 23, 1987

[30] Foreign Application Priority Data

| | | | |
|---|---|---|---|
| Oct. 25, 1986 | [JP] | Japan | 61-254456 |
| Oct. 25, 1986 | [JP] | Japan | 61-254457 |
| Dec. 29, 1986 | [JP] | Japan | 61-311176 |

[51] Int. Cl.[4] ..... B27D 1/00

[52] U.S. Cl. ..... 144/350; 144/348; 144/351; 144/380; 156/283; 156/298; 156/300; 427/185

[58] Field of Search ..... 144/348, 350, 351; 156/283, 298, 300; 427/185

[56] References Cited

U.S. PATENT DOCUMENTS

| | | | |
|---|---|---|---|
| 2,544,935 | 3/1951 | Orner | 144/350 |
| 3,969,558 | 7/1976 | Sakashige | 144/350 |
| 4,496,415 | 1/1985 | Sprengling | 156/283 |
| 4,596,623 | 6/1986 | Matsumoto et al. | 156/283 |
| 4,731,140 | 3/1988 | Yontrarak | 144/350 |
| 4,743,509 | 5/1988 | Kokrhanek | 144/348 |

FOREIGN PATENT DOCUMENTS

| | | | |
|---|---|---|---|
| 139618 | 5/1985 | European Pat. Off. | 144/380 |
| 118803 | 9/1980 | Japan | 144/350 |
| 1412903 | 11/1975 | United Kingdom | 144/351 |

*Primary Examiner*—W. Donald Bray

*Attorney, Agent, or Firm*—Ostrolenk, Faber, Gerb & Soffen

[57] ABSTRACT

In production of a decorative article from piece board of a decorative plywood, a decorative sheet for the decorative plywood is formed by heat pressing a powdery sheet on a material sheet in order to simplify coating process.

25 Claims, 5 Drawing Sheets

METHOD FOR PRODUCING WOODEN DECORATIVE ARTICLES

BACKGROUND OF THE INVENTION

The present invention relates to an improved method for producing wooden decorative articles, and more particularly relates to improvements in production of wooden decorative articles such as musical instruments and furniture from decorative plywoods.

In conventional method for producing such wooden decorative articles, a decorative sheet made of oak, walnut or teak is overlaid on and bonded to a base board made of lauan, particle boards or fiber boards to form a decorative plywood which is next cut into piece boards of various shapes. Cut ends of each piece board is covered by decorative sheets or synthetic resin tapes or coated with paints. Thereafter, the piece boards are assembled together to form a decorative article which is then subjected to coating with paints, sanding and polishing for finish treatment. That is, coating with paints has to be applied to the decorative article of a three-dimensional construction. Such coating process generally includes surface treatment, colouring, sealing, wood filling, polishing, base coating, polishing, one or two times of finish coating, sanding and finish polishing. Thus, a lot of operational steps have to be carried out in sequence.

Such a process lowers production efficiency and requires highly skilled manual works, which are quite unsuited for automation of the production process.

In order to avoid such operational disadvantage, it is proposed to subject a decorative plywood first to coating with polyurethane or aminoalkide resin paints and finish treatment. The pre-finished decorative plywood is then processed to cutting into piece board, assembly to a decorative article and finish coating with paints. Although coating with paints is applied to a flat object, i.e. the decorative plywood, this proposed process still necessitates a lots of operational steps. Use of organic solvents in coating causes pollution of the working environment.

SUMMARY OF THE INVENTION

It is the object of the present invention to reduce the number of operational steps, in particular relating to coating process, in production of wooden decorative articles without any risk of environment pollution.

In accordance with the basic aspect of the present invention, a resin layer is formed on a material sheet via heatpressing of powdery thermosetting resin deposited on its surface to form decorative sheet which is then over laid on and bonded to a base board to form a decorative plywood.

DESCRIPTION OF THE PREFERRED EMBODIMENTS

Figure 1:
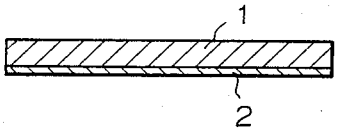
FIGS. 1 to 5 are sectional side views of sequential operational steps employed in one embodiment of the present invention.

Operational steps employed in one (the first) embodiment of the present invention are sequentially shown in FIGS. 1 to 5. In FIG. 1, a material sheet 1 is overlaid on and bonded to a backing 2. The material sheet 1 is made of a wooden sheet of beautiful grain such as walnut, rosewood, teak, spruce, Zelkova serrata and oak, and its thickness is preferably in a range from 0.2 to 0.8 mm. When necessary, colouring and/or sanding may be applied to the face of the material sheet 1. For colouring, dyes or pigment is dissolved with water or organic solvent, and small amount of resin may be additionally mixed. Colouring is carried out by brushing, spraying or wiping. Sanding is carried out with abrasive papers of 180 to 240 in order to remove raised surface grain. Proper designs and/patterns may be developed on the face of the material sheet 1 via screen printing, gravure printing and/or offset printing. Epoxy resin and polyurethane resin are preferably used as vehicles for such printing. In particular, designs such as abstract designs are preferably be printed on the material sheet 1.

The backing 2 is attached in order to prevent cracking and/or warping of the material sheet 1 at a weight of 20 to 100 g/m$^2$. The backing 2 is preferably made of a nonwoven fabric of synthetic fibers or glass fibers, a metallic foil such as aluminum foil, or a Japanese paper. For bonding of the backing 2, vinyl acetate emulsion type bonds, melamine resin type bonds and urea resin type bonds are preferably usable.

Figure 2:
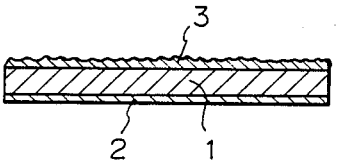

Next, as shown in FIG. 2, a powdery resin layer 3 is formed on the face of the material sheet 1. Thermosetting resins such as epoxy resin, unsaturated polyester resin, epoxy polyester resin, epoxy phenol resin and thermosetting acrylic resin are preferably used. Thermoplastic resins such as acrylic resin are also usable. Grain size is preferably in a range from 10 to 300 $\mu$m. Formation of the resin layer 3 is carried out via, for example, electrostatic coating and gravity spraying preferably at a weight of 100 to 300 g/m$^2$. After heating at a high temperature for a short time, partly fluid resin is deposited on the face of the material sheet 1. Heating is carried out in an infrared heating furnace or in an inductive heating furnace.

For quick thermosetting, a mixture of novolak type epoxy resin with bisphenol A type resin is preferably used with 2-ethyl-4-methyl-imidazole as a hardner. As a substitute for use of such a mixture, powdery epoxy resin may be deposited on the face of the material sheet 1 after coating with liquid epoxy resin. Paste type mixture may be applied to the face of the material sheet by a roll coater or a doctor blade.

Figure 3:
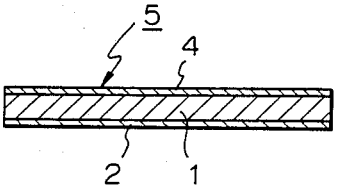

Next the material sheet 1 accompanied with the backing 2 and the powdery resin sheet 3 is sandwiched between easily releasable films such as vinyl fluoride films and subjected to heat pressing by, for example, a hot press. By this heat pressing, molten resin partly permeates into the material sheet 1 leaving a resin layer 4 on the face of the material sheet 1 to form a decorative sheet 5. The resin layer 4 should preferably be transparent without any colour or with light colours so that grain of the material sheet 1 should be externally visible and its thickness should preferably be in a range from 100 to 300 μm. Process conditions in the heat pressing are chosen depending on the kind and thickness of the material sheet 1 and the powdery resin layer 3. When the above-described epoxy resins are used, heat pressing is carried out at a temperature of 120°to 140° C., under a pressure of 0.2 to 1.5 MPa and for a period of 5 to 10 min. After removal of the easily releasable films, the decorative sheet 5 includes, as shown in FIG. 3, the material sheet 1, the backing 2 and the resin sheet 4 put together in one body. Texture of the decorative sheet 5 can be adjusted as wanted by proper choice of the easily releasable films.

In one alternative of the present invention, powdery resin layers may first be formed on both faces of a material sheet for subsequent bonding of a backing concurrent with heat pressing.

Figure 4:
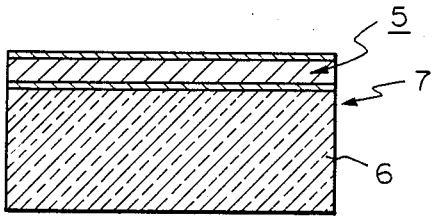

Next as shown in FIG. 4, the decorative sheet 5 is overlaid on and bonded to a base board 6 to form a decorative plywood 7. A lauan plywood, a particle board or a fiber board is used for this purpose. For bonding, bonds mainly containing EVA resin, vinyl acetate resin, a vinyl acetate resin-urea resin mixture or melamine resin are used. Bond papers or nonwoven sheet impregnated with such bonds are also usable. Bonding is preferably carried out at a temperature of 100°to 120° C., under a pressure of 0.1 to 1 MPa and for a period of 5 to 10 min. A rough sheet made of Japanese paper of nonwoven fabric may be inserted between the decorative sheet 5 and the base board 6 for better bonding.

Figure 5:
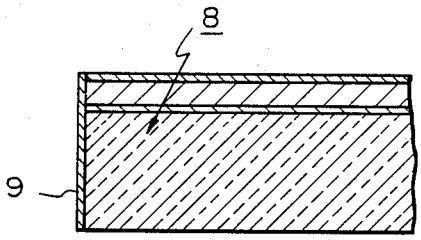

The decorative plywood 7 is cut into piece boards of various shapes according to the design of the end product. Cut ends of the piece boards to be exposed outwards on the end product are treated as shown in FIG. 5, in which a cut end is covered with a decoration tape 9. Cut ends may be coated with paints of colours close to that of the face of the decorative sheet 5. After such cut end treatment, the piece boards are properly assembled together to form a crude decorative article.

After assembly, the crude decorative article is coated with paints which adhere well to the resin layer 4 on the decorative sheet 5. Unsaturated polyester resin paints, polyurethane resin paints and epoxy resin paints are usually used for this finish coating. Prior to this coating, the face of the resin layer 4 may be sanded with a sanding paper of 240 to 400, and further by a sanding paper of 400 to 800. The finish coating may be applied to the piece boards after cut end treatment but before assembly. Flat state of the piece boards enables easier coating and, even, automatic coating.

Use of the powdery resin for formation of the resin layer 4 simplifies coating process greatly since no rough and intermediate coating are needed. Use of no solvents removes the risk of environment pollution. Most of the coating stems can be carried by an automatic system.

Figure 6:
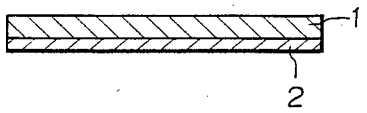
FIGS. 6 to 9 are sectional side views of sequential operational steps employed in another embodiment of the present invention.
Figure 7:
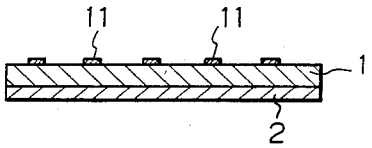

Operational steps employed in another (the second) embodiment of the present invention are sequentially shown in FIGS. 6 to 9. As in the case of the first embodiment, a backing 2 is attached to a material sheet 1 as shown in FIG. 6. Next, one or more decorative layers 11 are formed on the face of the material sheet 1 via manual painting, screen printing, gravure printing or offset printing as shown in FIG. 7. As vehicles for formation of the decorative layers 11, thermosetting resins such as epoxy resin, polyurethane resin, ultraviolet settable polyurethane acylate resin and epoxy acrylate resin are usable. The thickness of the decorative layers 11 should preferably be in a range from 10 to 100 μm so that they should present three-dimensional impression on the end product. A thickness of more or less 30 μm is most favorable.

Figure 8:
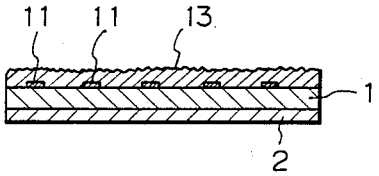
Figure 9:
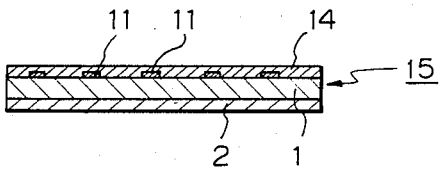

Next, a powdery resin sheet 13 is formed on the material sheet 1 fully covering the decorative layers 11 as shown in FIG. 8 in a manner substantially same as formation of the resin sheet 4 in the first embodiment. By application of like heat pressing, a decorative sheet 15 such as shown in FIG. 9 is obtained, which includes the material sheet 1, the backing 2, the decorative layers 11 and a resin sheet 14 growing from the powdery resin sheet 13 in one body to each other.

In this case, the design and/or the pattern of the decorative layers 11 overlaps the natural grain of the material sheet 1 in order to present a very unique appearance. Further, the decorative layers 11 are well protected by the resin sheet 14.

Figure 10:
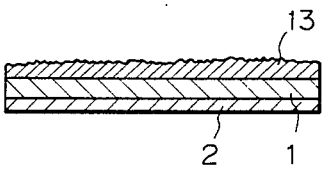
FIGS. 10 to 12 are sectional side views of sequential operational steps employed in the other embodiment of the present invention.
Figure 11:
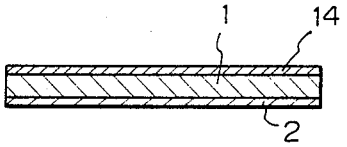
Figure 12:
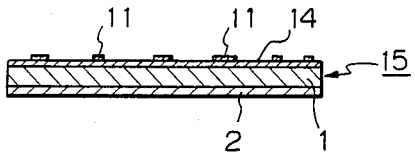

Operational steps employed in the other (the third) embodiment of the present invention are sequentially shown in FIGS. 10 to 11, in which a powdery resin sheet 13 is formed directly on the material sheet 1 after attachment of a backing 2. The powdery resin sheet 13 grows into a resin sheet 14 after heat pressing as shown in FIG. 11. Next, decorative layers 11 are formed on the resin sheet 14. Since the decorative layers 11 are located over the face of the material sheet 1, designs and/or patterns of the decorative layers 11 appear in relief providing a highly three-dimensional impression. When damaged during use of the decorative article, the decorative layers 11 are easily accessible for repairment purposed. When required, however, the decorative layers 11 may be covered with a proper protective film of, for example, urethane resin or unsaturated polyester resin. These resins may be applied in the form of a coating, too.

Figure 13:
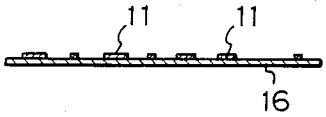
FIGS. 13 to 15 are sectional side views of sequential operational steps employed in a still other embodiment of the present invention.
Figure 14:
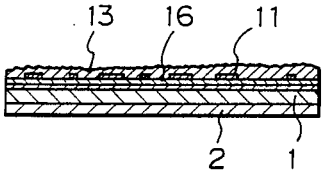
Figure 15:
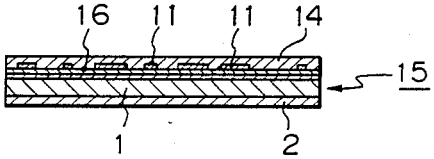

Operational steps employed in a still other (the fourth) embodiment of the present invention are sequentially shown in FIGS. 13 to 15, in which a thin material cloth 16 is used instead in addition to the material sheet 1 used in the foregoing embodiments. The material cloth 16 is made of a thin Japanese paper or an a crylic nonwoven fabric and its unit weight is in a range from 15 to 30 g/m$^2$. Decorative layers 11 are formed on the material cloth 16 as shown in FIG. 13. Then the material cloth 16 is placed on the material sheet 1 accompanied with a backing 2 before formation of a powdery resin sheet 13 as shown in FIG. 14. Thus, after heat pressing, a decorative sheet 15 includes the material sheet 1, the backing 2, the material cloth 16, the decorative layers 11 and a resin sheet 14 in one body to each other as shown in FIG. 15.

Figure 16:
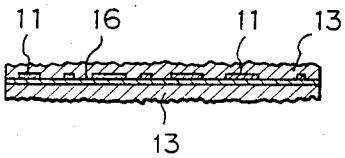
FIGS. 16 and 17 are sectional side views of sequential operational steps employed in a still other embodiment of the present invention.
Figure 17:
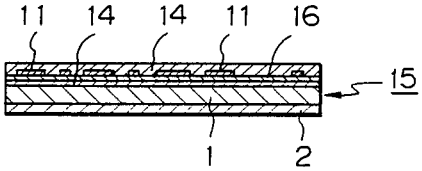

In the case of a still other (the fifth) embodiment shown in FIGS. 16 and 17, powdery resin layers 13 are formed on both faces of a material cloth 16 and the combination is overlaid on a material sheet 1 accompanied with a backing 2. The obtained decorative sheet 15 includes the material sheet 1, the backing 2, the material cloth 16, the decorative layers 11 and resin sheets 14 in one body to each other.

Figure 18:
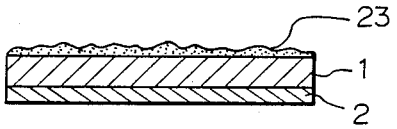
FIGS. 18 to 23 are side sectional views of sequential operational steps employed in a still other embodiment of the present invention.
Figure 19:
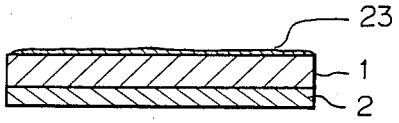
Figure 20:
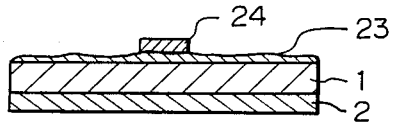
Figure 21:
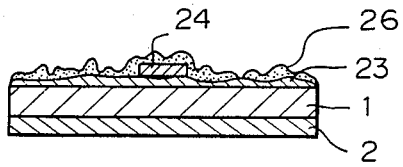
Figure 22:
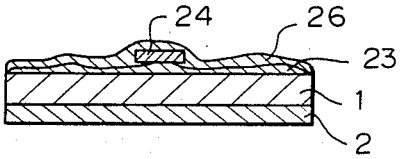
Figure 23:
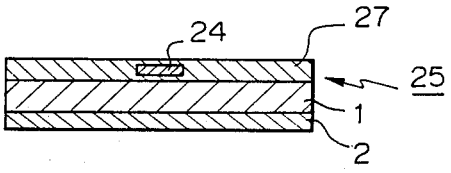

A further modification of this invention is shown in FIGS. 18 to 23, in which the product has an inlay construction. First, a powdery resin sheet 23 is formed on a material sheet 1, which may preferably accompanied with a thin backing 2, as shown in FIG. 18. Next, the powdery resin sheet 23 is molten by, for example, infrared radiation as shown in FIG. 19. In this molten state, one or more inlay pieces 24 are placed on the resin sheet 23 as shown in FIG. 20. The thickness of the inlay piece 24 is 0.3 mm or less, and preferably in a range from 0.1 to 0.2 mm. A further powdery resin sheet 26 is formed whilst fully covering the inlay pieces 24 as shown in FIG. 21. By application of infrared radiation, the additional powdery resin sheet 25 is molten as shown in FIG. 22. After heat pressing, a decorative sheet 25 has an inlay construction such as shown in FIG. 23. Thus, the decorative sheet 25 includes the material sheet 1, the backing 2, the inlay pieces 24 and a resin sheet 27.

In the case of this embodiment, no recesses for accommodating the inlay pieces 24 need to be formed in the material sheet 1. Further, no gap is developed around the inlay pieces 24. Absence of recesses greatly simplifies the inlay process and requires no highly skilled manual technique to make the process well suited for automation.

Figure 24:
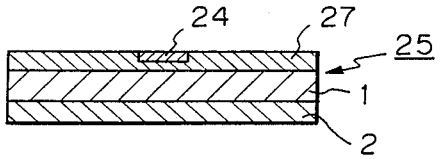
FIGS. 24 and 25 are side sectional views of products produced by the method in accordance with the present invention.
Figure 25:
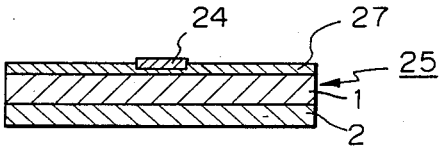

In one modified embodiment, the material sheet 1 may be directly subjected to heat pressing after deposition of the inlay pieces 24 to form a decorative sheet 25 such as shown in FIG. 24. When resin is applied in a liquid state, a decorative sheet 25 such as shown in FIG. 25 is obtained in which the inlay pieces 24 partly project from the resin sheet 27.

Figure 26:
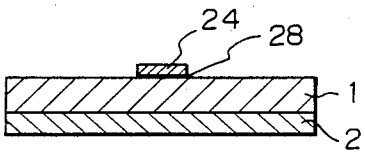
FIGS. 26 to 29 are side sectional views of sequential operational steps employed in a still other embodiment of the present invention.
Figure 27:
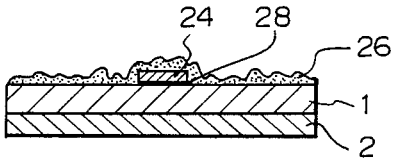
Figure 28:
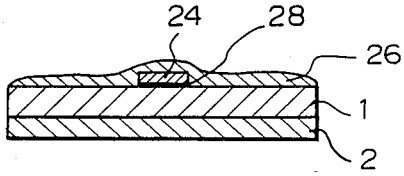
Figure 29:
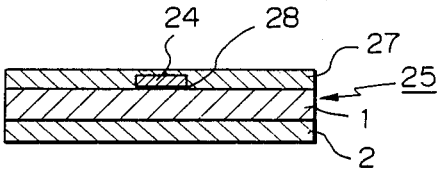

A still other (sixth) embodiment of the present invention is shown in FIGS. 26 to 29, in which an inlay piece 24 is attached to a main sheet 1 via a bond layer 28 as shown in FIG. 26. A powdery resin sheet 26 is then formed on the material sheet 1 whilst fully covering the inlay piece 24 as shown in FIG. 27 and the powdery resin sheet 26 is molten as shown in FIG. 28. After heat pressing, an obtained decorative sheet 25 includes the material sheet 1, the backing 2, the inlay piece 24, the bond layer 28 and a resin sheet 27 in one body to each other as shown in FIG. 29.

EXAMPLES

Example 1

A walnut veneer of 0.2 mm thickness was used for the material sheet which was accompanied with a backing made of a vinylon non-woven fabric of 30 g/m$^2$ unit weight. The bond contained 100 parts by weight of vinyl acetate resin, 100 parts by weight of urea resin and 1 part by weight of ammonium chloride. The unit weight of the bond was 100 g/m$^2$. Bonding was carried out at a temperature of 110° C., under a pressure of 0.7 MPa and for a period of 2 min. The surface of the material sheet was then sanded with a sanding paper of 240, coloured with oily dyes and screen printed for formation of a pattern. Powdery epoxy resin sheet was formed on the material sheet at 200 g/m$^2$ unit weight by electrostatic coating. The grain size was about 100 mesh and the powdery contained 100 parts by weight of solid epoxy resin and 3 parts by weight of 2-ethyl-4-methyl-imidazole. The powdery resin sheet was then molten in a far-infrared furnace of 450° C. panel temperature for 20 sec. A vinylon nonwoven fabric of 24 g/m$^2$ unit weight and a releasable film of polyvinyl fluoride are applied to the rear face of the material sheet and a same releasable film was applied to the top face of the material sheet for heat pressing which was carried out in a hot press at a temperature of 130° C., under a pressure of 1.0 MPa and for a period of 10 min. After cooling to the room temperature, the releasable films were removed to obtain a decorative sheet with a smooth resin sheet. The thickness of the decorative sheet was in a range from 180 to 190 μm.

Next, the decorative sheet was overlaid on and bonded to a lauan base board of 20 mm thickness to form a decorative plywood. A mixture of vinyl acetate resin with urea resin was used for bonding which was carried out at a temperature of 100° C., under a pressure of 1.0 MPa and for a period of 10 min. The decorative plywood was then cut into piece boards and the cut ends were covered with narrow tapes of the above-described decorative sheet by polyester resin type bond.

The piece boards were roughly ground with a sanding paper of 240, coated with polyester type resin paints, and finish polished with a sanding paper of 600.

After buffing and finish coating, the piece boards were assembled to form a sideboard on which the nature walnut grain was beautifully combined with the printed pattern.

Example 2.

A decorative sheet was prepared in a manner substantially same as in Example 1 but with exceptions that one or more decorative layers were formed on the material sheet via the screen printing, and that no vinylon nonwoven fabric was attached to the rear face of the material sheet prior to the heat pressing. On the obtained decorative sheet, the artificial pattern of the decorative layers were beautifully superposed on the natural grain of the walnut.

Example 3.

A decorative sheet was prepared in a manner substantially same as in Example 2 with an exception that formation of the resin sheet preceded formation of the decorative layers by the screen printing.

Example 4.

A yedo spruce plate of 3.0 mm thickness was used for the material sheet and, after attachment of a backing and surface polishing, an epoxy powdery resin sheet of 100 mesh or lower was formed on the face of the material sheet via electrostatic coating. The resin contained 100 parts by weight of solid epoxy resin, 1 part by weight of 2-ethyl-4-methyl-imidazole and 1 part by weight of undecyle imidazole. After melting by a far-infrared radiation at 450° C. panel temperature, inlay pieces were placed on the resin coated material sheet. Spruce pieces of various colours of 1 mm$^3$ were used for the inlay pieces. The combination was then processed in a manner substantially same as in Example 1.

I claim:

1. An improved method for producing a decorative plywood, said method comprising the steps of:
   - forming a powdery resin sheet on a material sheet;
   - heatpressing said powdery resin sheet with said material sheet to form a decorative sheet; and
   - attaching said decorative sheet to a base board to form a decorative plywood.

2. An improved method as claimed in claim 1 further comprising the step of forming one or more decorative layers on said material sheet before formation of said powdery resin sheet, said decorative layers being subsequently fully covered by said powdery resin sheet.

3. An improved method as claimed in claim 1 further comprising the steps of forming one or more decorative layers on said powdery resin sheet, and covering said decorative layers with a further powdery resin sheet before heat pressing.

4. An improved method as claimed in claim 1 further comprising the steps of forming one or more decorative layers on a material cloth, and attaching said material cloth to said material sheet before formation of said powdery resin sheet.

5. An improved method as claimed in claim 1 further comprising the steps of placing one or more inlay pieces on said powdery resin sheet, and covering said inlay pieces with a further powdery resin sheet before heat pressing.

6. An improved method as claimed in any one of claims 1 to 4 in which said powdery resin sheet contains one of epoxy resin, unsaturated polyester resin, epoxy polyester resin, epoxy phenol resin, thermosettable acrylic resin and acrylic resin.

7. An improved method as claimed in any one of claims 1 to 4 in which the unit weight of said powdery resin sheet is in a range from 100 to 300 g/m$^2$.

8. An improved method as claimed in any one of claims 1 to 4 in which heat pressing is carried out at a temperature of 120°to 140° C.

9. An improved method as claimed in any one of claims 1 to 4 in which heat pressing is carried out under a pressure of 0.2 to 1.5 MPa.

10. An improved method as claimed in any one of claims 1 to 4 in which heat pressing is carried out for a period of 5 to 10 min.

11. An improved method as claimed in any one of claims 1 to 4 in which attachment of said decorative sheet to said base board is carried out with a bond containing one of EVA resin, vinyl acetate resin, a mixture of vinyl acetate resin with urea resin and melamine resin.

12. An improved method as claimed in claim 11 in which bonding is carried out at a temperature of 100°to 120° C.

13. An improved method as claimed in claim 11 in which bonding is carried out under a pressure of 0.1 to 1 MPa.

14. An improved method as claimed in any one of claims 1 to 4 in which the thickness of said material sheet is in a range from 0.2 to 0.8 mm.

15. An improved method for producing a decorative article, said method comprising the steps of:

forming a decorative plywood according to claim 1;

cutting said decorative plywood into piece boards; and assembling said piece boards to form a decorative article.

16. An improved method as claimed in claim 15, further comprising the steps of:

forming one or more decorative layers on said powdery resin sheet; and covering said decorative layers with a further powdery resin sheet before heating.

17. An improved method as claimed in claim 16, in which the thickness of said material sheet is in a range from 0.2 to 0.8 mm.

18. An improved method as claimed in claim 16, in which said powdery resin sheet contains one of epoxy resin, unsaturated polyester resin, epoxy polyester resin, epoxy phenol resin, thermosettable acrylic resin and acrylic resin.

19. An improved method as claimed in claim 16, in which the unit weight of said powdery resin sheet is in a range from 100 to 300 g/m$^2$.

20. An improved method as claimed in claim 16, in which heat pressing is carried out at a temperature of 120°to 140° C.

21. An improved method as claimed in claim 16, in which heat pressing is carried out under a pressure of 0.2 to 1.5 MPa.

22. An improved method as claimed in claim 16, in which heat pressing is carried out for a period of five to ten minutes.

23. An improved method as claimed in claim 16, in which attachment of said decorative sheet to said baseboard is carried out with a bond containing one of EVA resin, vinyl acetate resin, a mixture of vinyl acetate resin with urea resin and melamine resin.

24. An improved method as claimed in claim 23, in which bonding is carried out at a temperature of 100°to 120° C.

25. An improved method as claimed in claim 23, in which bonding is carried out under a pressure of 0.1 to 1 MPa

* * * * *